US007928912B2

(12) United States Patent
Chen et al.

(10) Patent No.: US 7,928,912 B2
(45) Date of Patent: Apr. 19, 2011

(54) MULTIBAND ANTENNA

(75) Inventors: Wen-Hua Chen, Beijing (CN); Xin Wang, Beijing (CN); Zheng-He Feng, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 381 days.

(21) Appl. No.: 12/171,428

(22) Filed: Jul. 11, 2008

(65) Prior Publication Data

US 2009/0015487 A1 Jan. 15, 2009

(30) Foreign Application Priority Data

Jul. 13, 2007 (CN) ..... 2007 1 0076042

(51) Int. Cl.
*H01Q 9/04* (2006.01)

(52) U.S. Cl. ..... 343/700 MS; 343/702; 343/826; 343/828; 343/846

(58) Field of Classification Search ..... 343/700 MS, 343/702, 826, 828, 829, 830, 833, 834, 846
See application file for complete search history.

(56) References Cited

U.S. PATENT DOCUMENTS 6,697,023 B1 * 2/2004 Tiao-Hsing et al. ..... 343/702

* cited by examiner

*Primary Examiner* — Jacob Y Choi
*Assistant Examiner* — Darleen J Stockley
(74) *Attorney, Agent, or Firm* — D. Austin Bonderer

(57) ABSTRACT

A multiband antenna includes a long radiating branch, a short radiating branch, a short strip, a feed point, a grounding portion, a connecting portion, a long parasitic strip, and a short parasitic strip. The feed point, the long radiating branch, the short radiating branch, and the short strip are in a first plane. The grounding portion connects to the short strip. The connecting portion connects the long radiating branch, the short radiating branch, and the short strip. The long radiating branch, the short strip, and the connecting portion form a first inverted-L shaped antenna structure. The short radiating branch, the short strip, and the connecting portion form a second inverted-L shaped antenna structure. The long parasitic strip and the short parasitic strip are in a second plane and respectively connected to the grounding portion. The first plane is parallel to the second plane.

7 Claims, 6 Drawing Sheets

MULTIBAND ANTENNA

BACKGROUND

1. Field of the Invention

The present invention relates to multiband antennae and, particularly, to a multiband antenna used in a portable wireless device.

2. Discussion of Related Art

Following the advancement in recent years of wireless communication technology, various wireless devices, such as mobile phones, global positioning systems (GPSs), wireless local-area networks (WLANs), Bluetooth and the like, have been developed. In such devices, antennae are indispensable. In different regions of the world, wireless communications use different frequencies. To cover as many frequencies as possible, antennae require a large frequency bandwidth. The wireless devices have further been faced with demands for smaller size, lighter weight and increased functionality. To meet such demands, the wireless devices tend to employ antennae with a more compact dimension, whereby, to be installed inside the devices, the antennae need to conform to a very small space, while still performing satisfactorily. However, decreased dimensions decrease the bandwidth thereof accordingly.

What is needed, therefore, is to provide a multiband antenna combining good performance and high bandwidth with small dimension.

SUMMARY

In one embodiment, a multiband antenna includes a long radiating branch, a short radiating branch, a short strip, a feed point, a grounding portion, a connecting portion, a long parasitic strip, and a short parasitic strip. The feed point, the long radiating branch, the short radiating branch, and the short strip are in a first plane. The grounding portion is connected to the short strip. The connecting portion connects the long radiating branch, the short radiating branch, and the short strip. The long radiating branch, the short strip, and the connecting portion form a first inverted-C shaped antenna structure. The short radiating branch, the short strip, and the connecting portion form a second inverted-C shaped antenna structure. The long parasitic strip and the short parasitic strip are in a second plane and respectively connected to the grounding portion. The first plane is parallel to the second plane.

Other advantages and novel features of the present multiband antenna will become more apparent from the following detailed description of exemplary embodiments, when taken in conjunction with the accompanying drawings.

BRIEF DESCRIPTION OF THE DRAWINGS

Many aspects of the present multiband antenna can be better understood with reference to the following drawings. The components in the drawings are not necessarily to scale, the emphasis instead being placed upon clearly illustrating the principles of the present multiband antenna.

Figure 1:
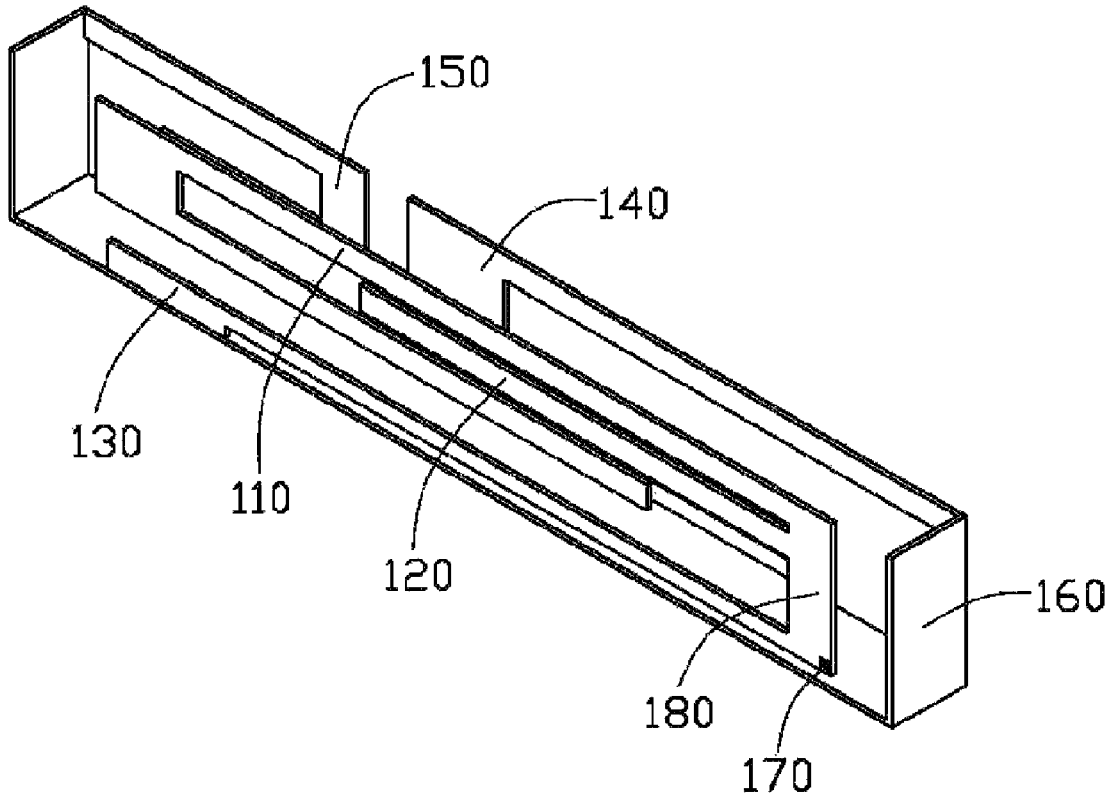
FIG. 1 is a perspective view of a multiband antenna extending in a first direction, in accordance with a present embodiment.

Corresponding reference characters indicate corresponding parts throughout the several views. The exemplifications set out herein illustrate at least one preferred embodiment of the present multiband antenna, in at least one form, and such exemplifications are not to be construed as limiting the scope of the invention in any manner.

DETAILED DESCRIPTION OF EXEMPLARY EMBODIMENTS

Reference will now be made to the drawings to describe, in detail, embodiments of the present multiband antenna.

Figure 2:
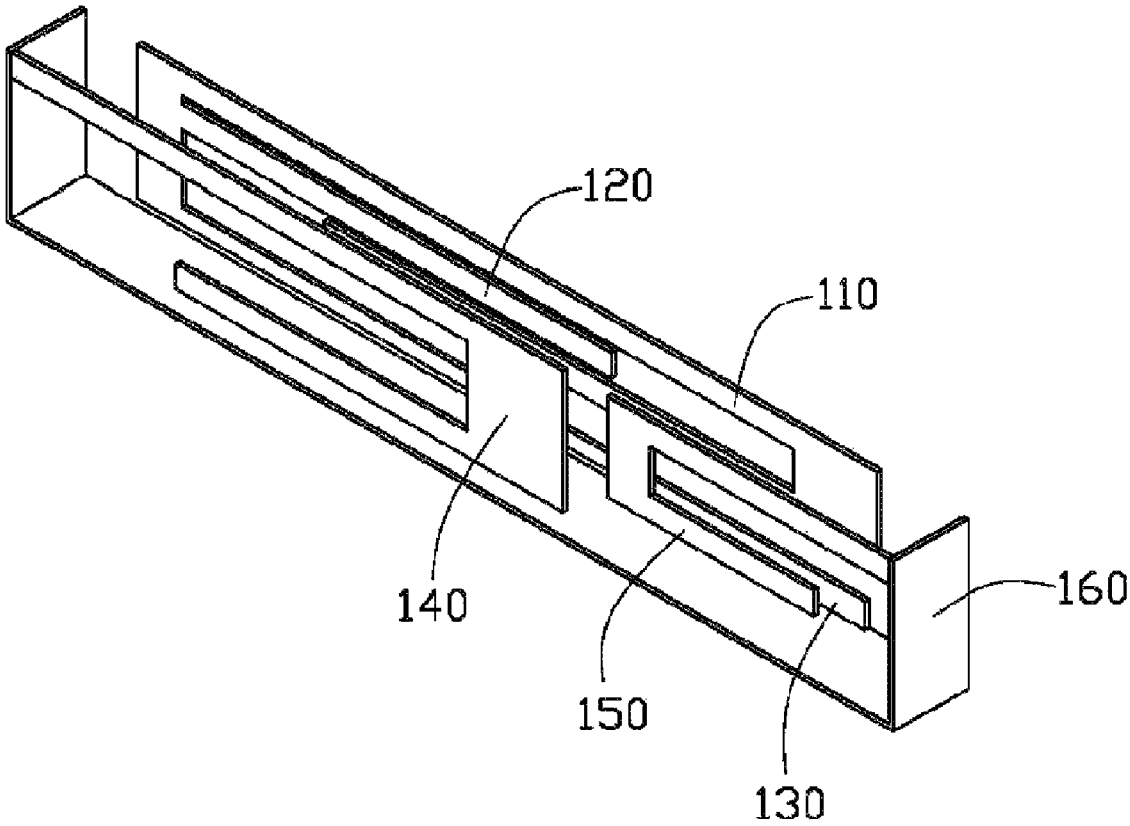
FIG. 2 is a perspective view of the multiband antenna of FIG. 1 extending in a second direction opposite to the first direction.

Referring to FIG. 1 and FIG. 2, a multiband antenna 100 includes a long radiating branch 110, a short radiating branch 120, a short strip 130, a feed point 170, a long parasitic strip 140, a short parasitic strip 150, a grounding portion 160, and a connecting portion 180. The long radiating branch 110, the short radiating branch 120, the feed point 170, and the short strip 130 are in a first plane. The long parasitic strip 140 and the short parasitic strip 150 are in a second plane. The first plane is parallel to the second plane. The connecting portion 180 respectively connects the long radiating branch 110, the short radiating branch 120, and the short strip 130.

Figure 3:
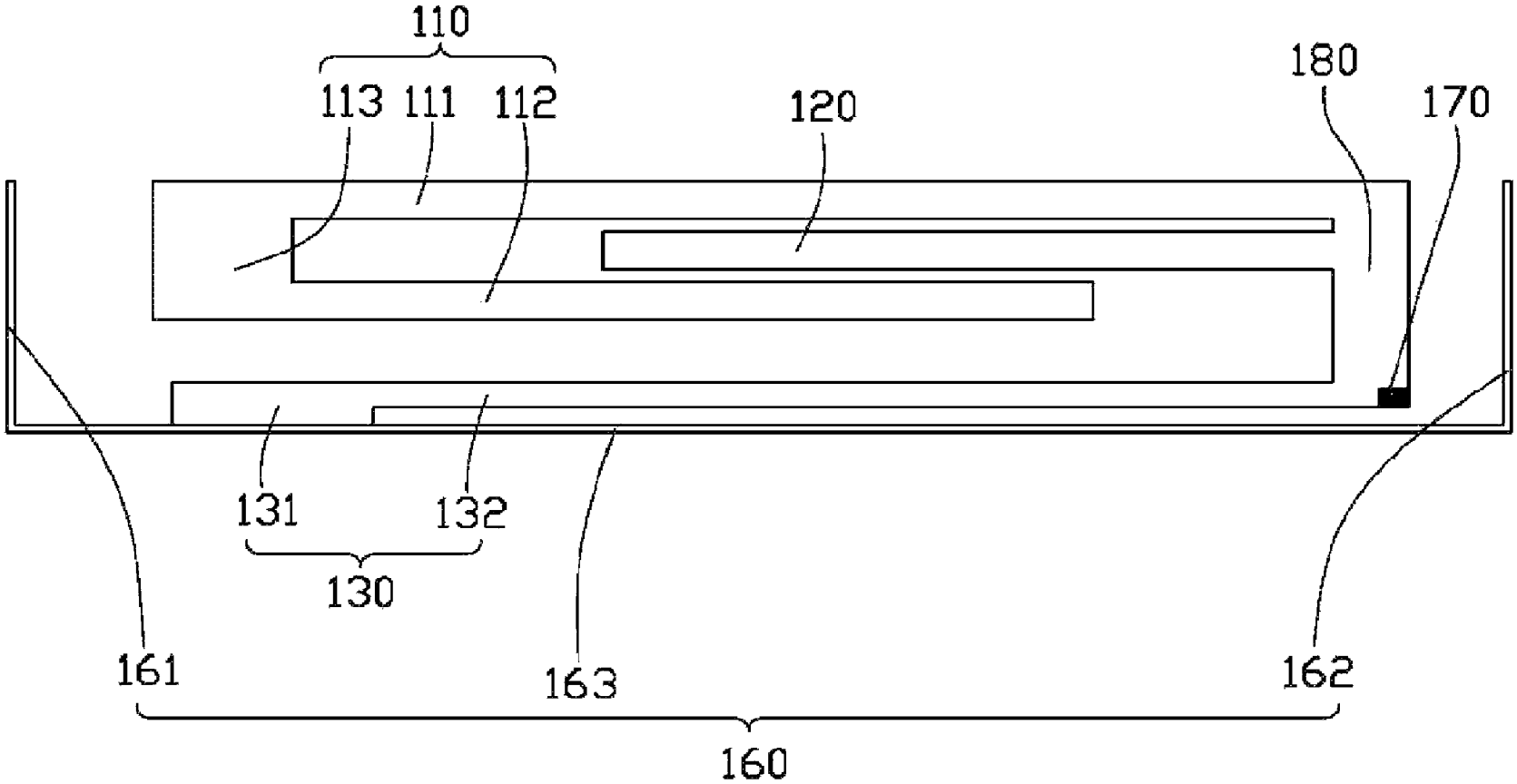
FIG. 3 is a top view of a long radiating branch, a short radiating branch, a short strip, and a grounding portion of the multiband antenna of FIG. 1.
Figure 4:
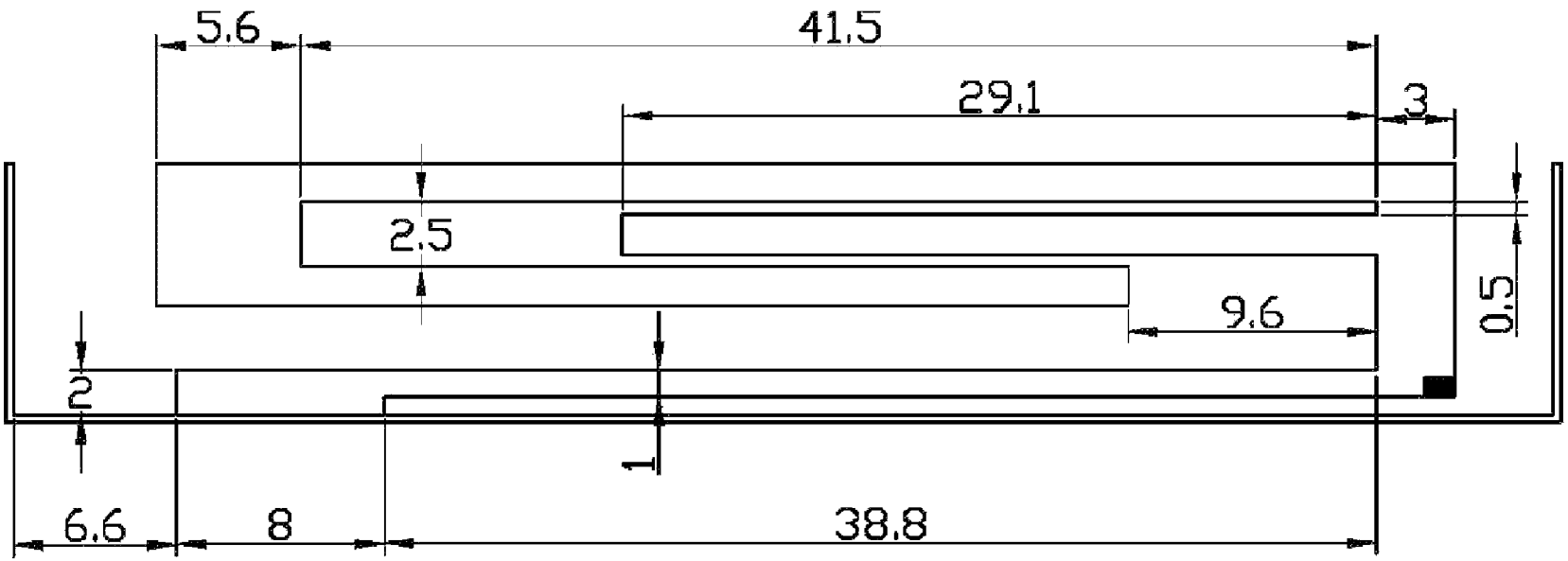
FIG. 4 is a top view of the long radiating branch, the short radiating branch, the short strip, and the grounding portion of the multiband antenna of FIG. 3 with dimensions indicated.

Referring to FIG. 3 and FIG. 4, the long radiating branch 110 is almost in a C shape, and includes a first horizontal portion 111, a second horizontal portion 112, and a vertical portion 113 connected to the first horizontal portion 111 and the second horizontal portion 112. A width of the first horizontal portion 111 is about 1.5 mm, and a length thereof is about 41.5 mm. A width of the second horizontal portion 112 is about 1.5 mm. A distance between the first horizontal portion 111 and the second horizontal portion 112 is about 2.5 mm. A length of the vertical portion 113 is about 5.6 mm.

The short radiating branch 120 is a strip, disposed between the first horizontal portion 111 and the second horizontal portion 112 of the long radiating branch 110. A width of the short radiating branch 120 is about 1.5 mm. A distance between the short radiating branch 120 and the vertical portion 113 of the long radiating branch 110 is about 12.4 mm.

The short strip 130 includes a first part 131 and a second part 132 extending from the first part 131. The first part 131 is wider than the second part 132. In one suitable embodiment, a length of the first part 131 is about 8 mm, and a width thereof is about 2 mm, a length of the second part 132 is about 38.8 mm, and a width thereof is about 1 mm. The top of the first part 131 and the second part 132 are in a same level.

The grounding portion 160 includes a first vertical plane 161, a second vertical plane 162 parallel to the first vertical plane 161, and a horizontal plane 163 connecting the first vertical plane 161 to the second vertical plane 162 to form a U-shaped grounding portion 160. The first vertical plane 161, the second vertical plane 162, and the horizontal plane 163 can be made of metallic materials. The bottom of the first part 131 of the short strip 130 is connected to the horizontal plane 163 of the grounding portion 160. The second part 132 of the short strip 130 is about 1 mm from the horizontal plane 163 of the grounding portion 160.

The connecting portion 180 is connected to the long radiating branch 110, the short radiating branch 120, and the short strip 130. More specifically, the connecting portion 180 is connected to the long radiating branch 110 at an end of the first horizontal portion 111 away from the vertical portion 113. The connecting portion 180 is also connected to the short radiating branch 120 at an end thereof away from the vertical portion 113 of the long radiating branch 110. The connecting portion 180 is also connected to the short strip 130 at an end of the second part 132 away from the first part 131. A length of the connecting portion 180 is about 3 mm. A distance between the connecting portion 180 and an end of the second horizontal portion 112 away from the vertical portion 113 is about 9.6 mm. The feed point 170 is disposed at an end of the connecting portion 180 near the second part 132.

The long radiating branch 110, the short strip 130, and the connecting portion 180, forming a first inverted-C shaped antenna structure, receive lower band signals of bandwidth of about 824~894 MHz for GSM850 operation. The short radiating branch 120, the short strip 130, and the connecting portion 180, forming a second inverted-C shaped antenna structure, receive upper band signals of about 1710~1880 MHz for DCS operation.

Figure 5:
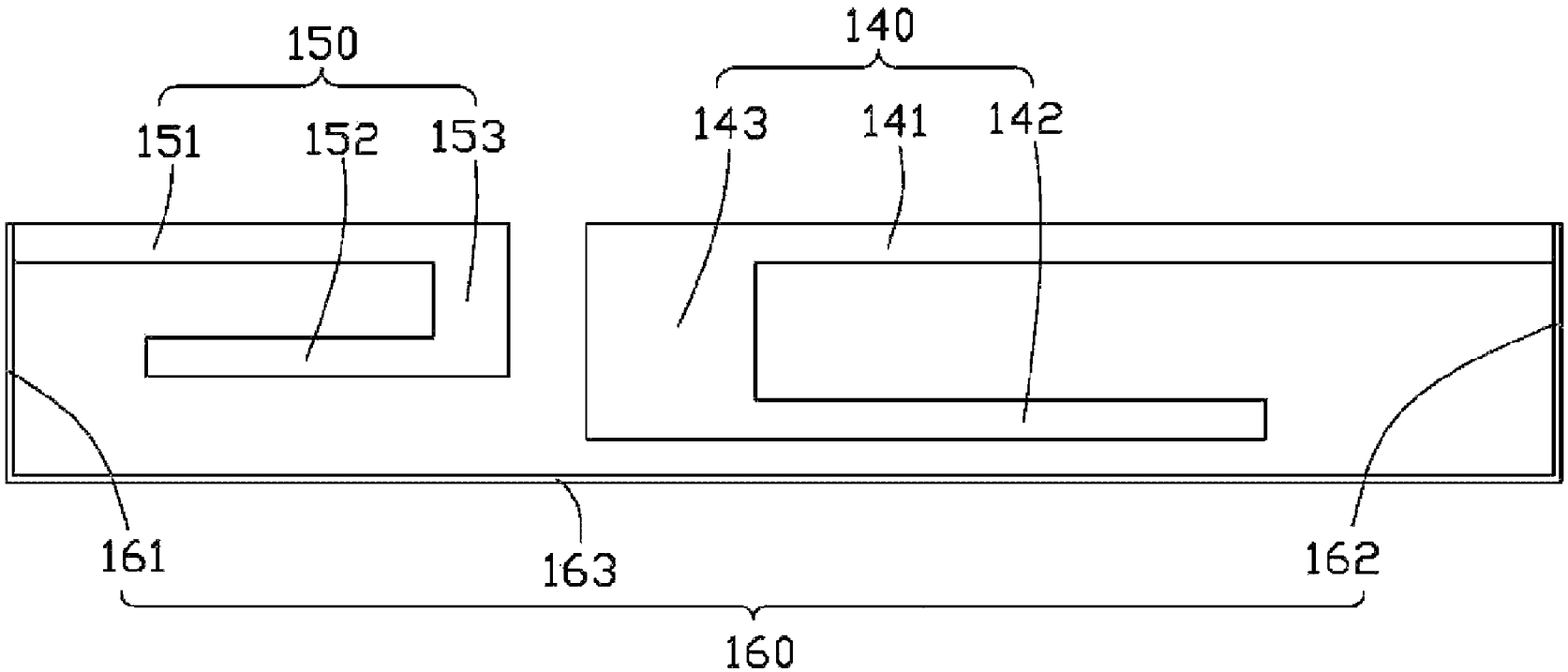
FIG. 5 is a top view of a long parasitic strip, a short parasitic strip, and a grounding portion of the multiband antenna of FIG. 1.
Figure 6:
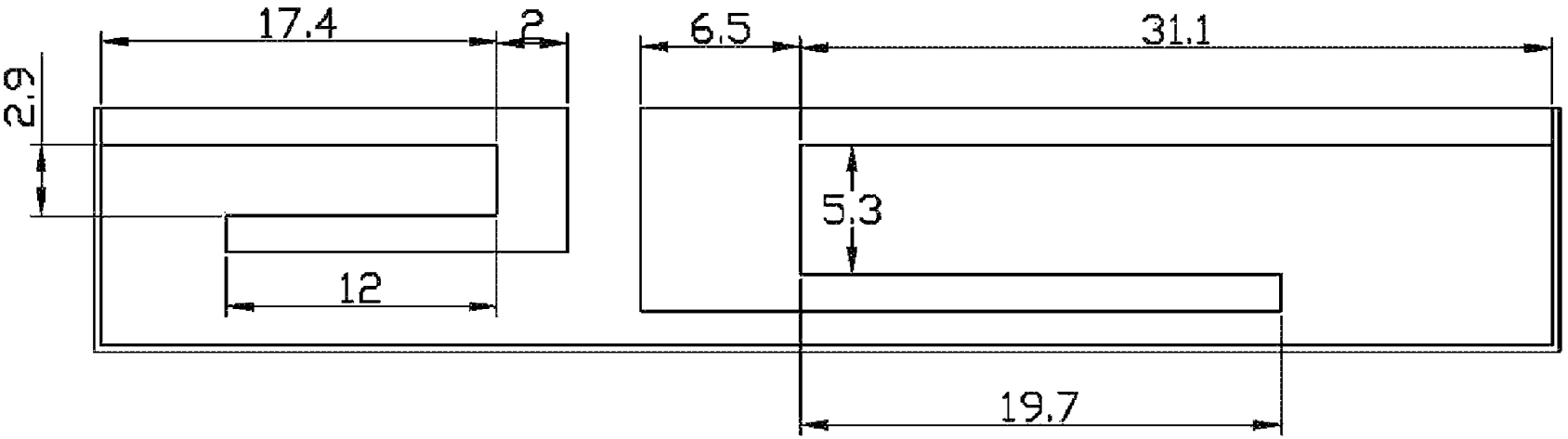
FIG. 6 is a top view of the long parasitic strip, the short parasitic strip, and the grounding portion of the multiband antenna of FIG. 5 with dimensions indicated.

Referring to FIG. 5 and FIG. 6, the long parasitic strip 140 disposed in the second plane is nearly C shaped. The long parasitic strip 140 includes a first horizontal portion 141, a second horizontal portion 142 parallel to the first horizontal portion 141, and a vertical portion 143 connected to the first horizontal portion 141 and the second horizontal portion 142. A width of the first horizontal portion 141 is about 1.5 mm, and a length thereof is about 31.1 mm. A width of the second horizontal portion 142 is about 1.5 mm, and a length thereof is about 19.7 mm. A distance between the first horizontal portion 141 and the second horizontal portion 142 is about 5.3 mm. A length of the vertical portion 143 is about 6.5 mm. The long parasitic strip 140 is connected to the second vertical plane 162 of the grounding portion 160 at an end of the first horizontal portion 141 away from the vertical portion 143.

The short parasitic strip 150 is disposed in the second plane in almost a C shape. The short parasitic strip 150 includes a first horizontal portion 151, a second horizontal portion 152 parallel to the first horizontal portion 151, and a vertical portion 153 connected to the first horizontal portion 151 and the second horizontal portion 152. A width of the first horizontal portion 151 is about 1.5 mm, and a length thereof is about 17.4 mm. A width of the second horizontal portion 152 is about 1.5 mm, and a length thereof is about 2.9 mm. A distance between the first horizontal portion 151 and the second horizontal portion 152 is about 2.9 mm. A length of the vertical portion 153 is about 2 mm. The short parasitic strip 150 is connected to the first vertical plane 161 of the grounding portion 160 at an end of the first horizontal portion 151 away from the vertical portion 153.

The long parasitic strip 140 receives lower band signals in a bandwidth of about 890~960 MHz for GSM900 operation. The long parasitic strip 140, working with the long radiating branch 110, extends the lower bandwidth of the multiband antenna 100. The lower bandwidth of the multiband antenna 100 covers the bandwidth of GSM850 and GSM900.

The short parasitic strip 150 receives upper band signals in a bandwidth of about 1850~1990 MHz for PCS operation. The short parasitic strip 150, working with the short radiating branch 120, extends the upper bandwidth of the multiband antenna 100. The upper bandwidth of the multiband antenna 100 covers the DSC and PCS bandwidths.

The multiband antenna 100 of the present embodiment uses the long parasitic strip 140 to enhance reception of lower band signals, and the short parasitic strip 150 to enhance reception of upper band signals. As such, the multiband antenna 100 has a wider bandwidth and a better receiving ability than a conventional antenna. The long parasitic strip 140, short parasitic strip 150, and the short strip 130 are all directly connected to the grounding portion 160, allowing the multiband antenna 100 to retain relatively small dimensions and be suitable for use in a portable device.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A multiband antenna comprising:
a long radiating branch in a first plane;
a short radiating branch in the first plane;
a short strip in the first plane;
a feed point in the first plane;
a grounding portion connected to the short strip;
a connecting portion connecting the long radiating branch, the short radiating branch, and the short strip; the long radiating branch, the short strip, and the connecting portion forming a first inverted-C shaped antenna structure to receive lower band signals; and the short radiating branch, the short strip, and the connecting portion forming a second inverted-C shaped antenna structure to receive upper band signals;
a long parasitic strip in a second plane parallel to the first plane, connected to the grounding portion; and
a short parasitic strip in the second plane, connected to the grounding portion.

2. The multiband antenna as claimed in claim 1, wherein the long radiating branch comprises a first horizontal portion, a second horizontal portion, and a first vertical portion connected to the first horizontal portion and the second horizontal portion.

3. The multiband antenna as claimed in claim 2, wherein the short radiating branch is a strip and is disposed between the first horizontal portion and the second horizontal portion of the long radiating branch.

4. The multiband antenna as claimed in claim 1, wherein the short strip comprises a first part and a second part extending from the first part, and the first part is wider than the second part and connected to the grounding portion.

5. The multiband antenna as claimed in claim 1, wherein the long parasitic strip comprises a third horizontal portion, a fourth horizontal portion parallel to the third horizontal portion, and a second vertical portion connected to the third horizontal portion and the fourth horizontal portion.

6. The multiband antenna as claimed in claim 1, wherein the short parasitic strip comprises a fifth horizontal portion, a sixth horizontal portion parallel to the fifth horizontal portion, and a third vertical portion connected to the fifth horizontal portion and the sixth horizontal portion.

7. The multiband antenna as claimed in claim 1, wherein the grounding portion comprises a first vertical plane, a second vertical plane parallel to the first vertical plane, and a horizontal plane connecting the first vertical plane to the second vertical plane, and the first vertical plane, the second vertical plane, and the horizontal plane are respectively connected to the short parasitic strip, the long parasitic strip, and the short strip.

* * * * *